US008053962B2

(12) United States Patent
Kostka et al.

(10) Patent No.: US 8,053,962 B2
(45) Date of Patent: Nov. 8, 2011

(54) FLUORESCENT LAMP WITH UV-BLOCKING LAYER AND PROTECTIVE SLEEVE

(75) Inventors: James Michael Kostka, Mayfield Heights, OH (US); Jon B. Jansma, Pepper Pike, OH (US)

(73) Assignee: General Electric Company, Schenectady, NY (US)

( * ) Notice: Subject to any disclaimer, the term of this patent is extended or adjusted under 35 U.S.C. 154(b) by 255 days.

(21) Appl. No.: 12/435,215

(22) Filed: May 4, 2009

(65) Prior Publication Data

US 2010/0277056 A1 Nov. 4, 2010

(51) Int. Cl.

| | |
|---|---|
| ***H01J 5/16*** | (2006.01) |
| ***H01J 61/40*** | (2006.01) |
| ***H01K 1/26*** | (2006.01) |
| ***H01K 1/30*** | (2006.01) |

(52) U.S. Cl. ..... 313/112; 313/110

(58) Field of Classification Search ..... 313/110, 313/112

See application file for complete search history.

(56) References Cited

U.S. PATENT DOCUMENTS

| | | | | | |
|---|---|---|---|---|---|
| 2,135,696 | A | * | 11/1938 | Baumhauer et al. | 362/647 |
| 2,363,109 | A | * | 11/1944 | Keiffer | 313/25 |
| 2,791,679 | A | * | 5/1957 | Hierholzer, Jr. et al. | 362/645 |
| 3,124,307 | A | * | 3/1964 | Hoskins et al. | 362/659 |
| 3,179,792 | A | * | 4/1965 | Weiss | 362/645 |
| 3,351,409 | A | * | 11/1967 | McGuire | 359/460 |
| 3,358,167 | A | * | 12/1967 | Shanks | 313/25 |
| 3,453,470 | A | * | 7/1969 | Hammer | 313/25 |
| 3,602,759 | A | * | 8/1971 | Evans | 313/112 |
| 3,673,401 | A | * | 6/1972 | Du Pont | 362/377 |
| 3,751,653 | A | * | 8/1973 | Henry | 362/126 |
| 3,808,495 | A | * | 4/1974 | Win | 313/110 |
| 4,048,537 | A | * | 9/1977 | Blaisdell et al. | 313/489 |
| 4,924,368 | A | * | 5/1990 | Northrop et al. | 362/376 |
| 5,124,618 | A | | 6/1992 | Ohtaka et al. | |
| 5,173,637 | A | * | 12/1992 | Sica | 313/489 |
| 5,188,451 | A | * | 2/1993 | Shanks | 362/223 |
| 5,227,693 | A | * | 7/1993 | Sakakibara et al. | 313/489 |
| 5,291,379 | A | * | 3/1994 | Lu | 362/255 |
| 5,536,998 | A | * | 7/1996 | Sica | 313/489 |
| 5,602,444 | A | | 2/1997 | Jansma | |

(Continued)

FOREIGN PATENT DOCUMENTS

| | | |
|---|---|---|
| EP | 1176627 | 1/2002 |

(Continued)

OTHER PUBLICATIONS

European Search Report dated Aug. 10, 2010 for Applicant/Proprietor General Electric Company. Search completed on Aug. 4, 2010.

(Continued)

*Primary Examiner* — Nimeshkumar Patel
*Assistant Examiner* — Jose M Diaz
(74) *Attorney, Agent, or Firm* — Pearne & Gordon LLP

(57) ABSTRACT

A fluorescent lamp having a protective polymeric sleeve to provide impact resistance and contain fragments if the lamp shatters. A UV-blocking layer is coated on the outside of the glass envelope of the lamp or on the inside of the sleeve to help protect the polymeric sleeve from UV degradation. The UV-blocking layer includes a UV-blocking component of $Al_2O_3$ or ZnO or $SiO_2$ or $TiO_2$ or mixtures thereof.

18 Claims, 1 Drawing Sheet

U.S. PATENT DOCUMENTS

| | | | | |
|---|---|---|---|---|
| 5,729,085 | A * | 3/1998 | Sica et al. | 313/493 |
| 6,078,136 | A * | 6/2000 | Sica | 313/493 |
| 6,246,167 | B1 * | 6/2001 | Sica | 313/493 |
| 6,254,318 | B1 * | 7/2001 | Sica | 408/39 |
| 6,406,167 | B1 * | 6/2002 | Bock | 362/376 |
| 6,422,721 | B1 * | 7/2002 | Plunk et al. | 362/377 |
| 7,477,005 | B2 * | 1/2009 | Hlahol et al. | 313/11 |
| 7,500,896 | B2 * | 3/2009 | Trushell et al. | 445/26 |
| 2002/0187705 | A1 * | 12/2002 | Dupont et al. | 445/8 |
| 2004/0070324 | A1 * | 4/2004 | Lisitsyn | 313/271 |
| 2004/0178394 | A1 * | 9/2004 | Tanaka et al. | 252/586 |
| 2009/0209162 | A1 * | 8/2009 | Bartol | 445/44 |
| 2010/0232830 | A1 * | 9/2010 | Wada et al. | 399/111 |

FOREIGN PATENT DOCUMENTS

| | | | |
|---|---|---|---|
| WO | 2006006097 | | 1/2006 |
| WO | WO 2007108488 | A1 * | 9/2007 |

OTHER PUBLICATIONS

European Search Report dated Aug. 10, 2010 for Applicant/Proprietor General Electric Company. Search completed on Aug. 4, 2010. (This Search Report contains additional information than the previously cited Search Report submitted Aug. 26, 2010).

* cited by examiner

FLUORESCENT LAMP WITH UV-BLOCKING LAYER AND PROTECTIVE SLEEVE

BACKGROUND OF THE INVENTION

1. Field of the Invention

The present invention is directed to a fluorescent lamp with a UV-blocking layer which protects a protective polymeric sleeve surrounding the lamp.

2. Description of Related Art

Fluorescent lamps are susceptible to breaking if dropped or bumped. Coatings and sleeves have been developed for fluorescent lamps which have two functions: 1) to absorb impacts and thus impart increased impact resistance to the lamp, to reduce breakage, and 2) to act as a containment envelope to contain shards or fragments of glass in case the lamp shatters. Often, these coatings and sleeves are subject to degradation from UV-light emitted from the fluorescent lamp. Such degradation causes the coatings and sleeves to develop yellowing or haze that partially blocks transmission of visible light. Moreover, such degradation causes the coatings and sleeves to become more brittle over time, so that they are less able to provide impact resistance and act as containment envelopes. As a result, over time, the fluorescent lamp becomes less protected from breakage and, if it does shatter, the glass fragments are less likely to be contained by an intact containment envelope. Accordingly, there is a need for a protective sleeve that is less susceptible to UV-degradation.

SUMMARY OF THE INVENTION

A sleeve-protected fluorescent lamp comprising a mercury vapor discharge fluorescent lamp surrounded by a sleeve. The fluorescent lamp comprises a light-transmissive glass envelope having an inner surface, a pair of electrode structures mounted inside said envelope, a first base sealing a first end of the lamp, a second base sealing a second end of the lamp, a discharge-sustaining fill comprising inert gas sealed inside said envelope, and a phosphor layer inside said envelope and adjacent the inner surface of the envelope. The sleeve comprises a layer of polymeric material. The sleeve-protected lamp further comprises a UV-blocking layer between the polymeric material layer and the glass envelope. The UV-blocking layer comprises a UV-blocking component of $Al_2O_3$ or ZnO or $SiO_2$ or $TiO_2$ or mixtures thereof. The inside diameter of the sleeve is at least 0.2 mm greater than the outside diameter of the lamp so that there is a gap between the lamp and the sleeve.

DETAILED DESCRIPTION OF THE PREFERRED EMBODIMENTS OF THE INVENTION

In the description that follows, when a preferred range such as 5 to 25 (or 5-25), is given, this means preferably at least 5 and, separately and independently, preferably not more than 25. UV light is generally considered to be 10-400 nm.

Figure 1:
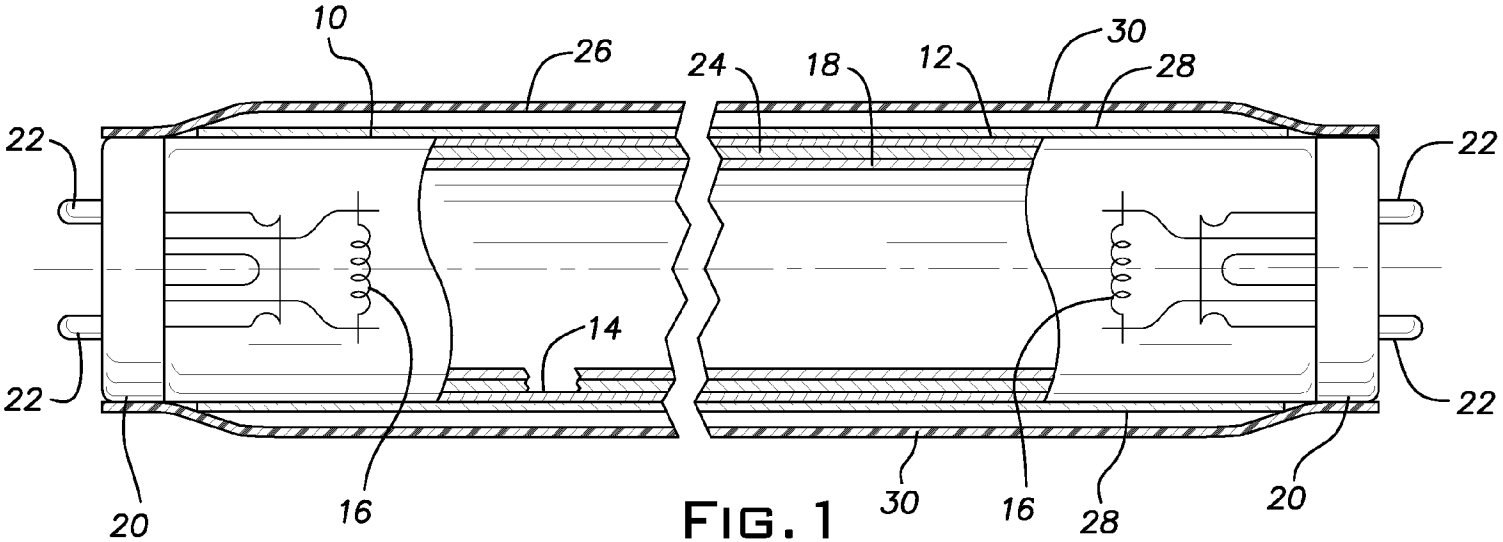
FIG. 1 shows schematically, in a first embodiment of the invention, a fluorescent lamp partially in cross section surrounded by a protective sleeve shown in cross section.

With reference to FIG. 1 there is shown a sleeve-protected fluorescent lamp, that is, a fluorescent lamp 10 surrounded by a sleeve 26 in accordance with a first embodiment of the invention. But for layer 28, fluorescent lamp 10 is a conventional mercury vapor discharge fluorescent lamp and includes a light-transmissive glass tube or envelope 12 having an inner surface 14, electrode structures 16 for providing an electric discharge to the interior of the glass envelope 12, a phosphor layer 18 within the interior of the glass envelope 12 and a discharge-sustaining fill comprising inert gas, for example, argon, neon, krypton, xenon or mixtures thereof, sealed within the glass envelope along with a small amount of mercury. Between the inner surface 14 of the envelope 12 and the phosphor layer 18 is preferably but not necessarily a barrier layer 24 as known in the art. The barrier layer 24 can be made, for example, of alumina.

The lamp 10 is hermetically sealed by bases 20 attached at both ends of the envelope 12. The electrode structures 16 are connected to pins 22 so that electric energy can be carried through the pins to the electrode structures 16. When the lamp 10 is energized, an electric arc is created between the electrode structures 16, the mercury is energized and emits UV light, and the phosphors in the phosphor layer absorb the UV light and re-emit light in the visible range. The barrier layer 24 permits visible light to pass through and functions to reflect UV light that has passed through the phosphor layer back into the phosphor layer where it can be utilized. Nonetheless, some UV light can escape out of the envelope 12 and potentially strike the protective sleeve 26.

Lamp 10 is preferably linear, such as 2, 3, 4, 6 or 8 feet long and preferably circular in cross section. Lamp 10 can be any diameter as known in the art, preferably ⅝, ¾, 1, 1¼ or 1½ inches in diameter, such as T5 to T12 lamps as known in the art. Lamp 10 is preferably a T8 or T12 lamp as known in the art.

FIG. 1 also shows UV-blocking layer 28 and sleeve 26. Sleeve 26 is preferably a conventional polymeric protective sleeve as known in the art and comprises a layer 30 of polymeric material. Layer 30 is light-transmissive or transparent and is preferably polycarbonate, polyester such as polyethylene terephthalate (PET), polyurethane, fluorinated polymers such as fluorinated ethylene propylene (FEP), or polyacrylate, each of these being preferably UV-stabilized by the addition of one or more UV-stabilizers as known in the art at conventional loading levels. Layer 30 is preferably UV-stabilized polycarbonate, such as Lexan 103 or Lexan RL7245 from Saudi Basic Industries Corporation (SABIC). Layer 30 is preferably about 100-1000, more preferably about 150-800, more preferably about 200-600, more preferably about 300-500, more preferably about 350-450, more preferably about 380-400, more preferably about 400, microns thick. As shown in FIG. 1, sleeve 26 surrounds envelope 12 and preferably has the same cross-sectional geometry as envelope 12; for example, preferably envelope 12 and sleeve 26 are both circular in cross section.

With reference to FIG. 1, UV-blocking layer 28 is coated on the outer surface of glass envelope 12 (and preferably not on the bases 20, since this could interfere with sealing the sleeve 26 to the bases 20). UV-blocking layer 28 comprises a UV-blocking component and preferably a binder (the binder may also be referred to as a host). The UV-blocking component is $Al_2O_3$ or ZnO or $SiO_2$ or $TiO_2$ or mixtures thereof. The UV-blocking component is preferably 0-100, more preferably 10-90, more preferably 20-80, more preferably 30-70, more preferably 35-60, more preferably 38-50, more preferably 40-45, alternatively 30-50 or 3040, weight percent $Al_2O_3$; the UV-blocking component can also be preferably 0-100, more preferably 10-90, more preferably 20-80, more preferably 30-70, more preferably 35-60, more preferably 38-50, more preferably 40-45, alternatively 30-50 or 30-40, weight percent ZnO; the UV-blocking component can also be preferably 0-100, more preferably 10-90, more preferably 20-80, more preferably 30-70, more preferably 35-60, more preferably 38-50, more preferably 40-45, alternatively 30-50 or 30-40, weight percent $SiO_2$; the UV-blocking component can also be preferably 0-100, more preferably 10-90, more preferably 20-80, more preferably 30-70, more preferably 35-60, more preferably 38-50, more preferably 40-45, alternatively 30-50 or 30-40, weight percent $TiO_2$. For example, the UV-blocking component can be 10-20 wt. % $SiO_2$, 40-45 wt. % $Al_2O_3$, and 40-45 wt. % ZnO, or the UV-blocking component can be 10-15 wt. % $SiO_2$, 10-15 wt. % $TiO_2$, 35-40 wt. % $Al_2O_3$, and 35-40 wt. % ZnO. Any other weight percent combinations of two or more of the four oxides can also be used.

For FIG. 1, the UV-blocking component is preferably mixed with a binder or host and coated on the outer surface of glass envelope 12, preferably by dip-coating, spray coating, coating with a slurry, or other coating methods known in the art. The binder is preferably an organic binder such as an epoxy; in addition the following organic binders are preferred: polysilanes, polyacrylics, polyurethanes, copolymers of these and others, or mixtures or blends thereof. An inorganic binder or host can also be used, for example aluminum phosphate, sodium borate, or dispersions of nanosized alumina and/or silica. Examples of the latter would be Degussa W630 alumina sol, or Cabot Cabosperse silica sols. After drying, layer 28 is preferably at least 75, 80, 85, 90 or 95 wt. % UV-blocking component and not more than 5, 10, 15, 20 or 25 wt. % binder or host. Preferably layer 28 is made from Product GUZ-140 from Nippan Kenkyujo Company, located in Yokohama, Japan. The main ingredients in GUZ-140 are $Al_2O_3$, ZnO and $SiO_2$; it has solids content of 25.2% and viscosity of 15. Alternatively, the respective weight percents of the ingredients in the UV-blocking component can be the same as the weight percents of the $Al_2O_3$, ZnO and $SiO_2$ in GUZ-140, plus or minus 10 weight percent each. After completion of application of layer 28 on envelope 12, the coating weight of the UV-blocking component in layer 28 is preferably 0.2-8, 0.2-7, 0.4-5, 0.7-4, 1-3, 1.5-2.5, 1.8-2.2, or about 2, mg/cm$^2$.

With reference to FIG. 1, after layer 28 is applied, sleeve 26 is slid onto and attached to fluorescent lamp 10 in a conventional manner, that is, adhesive is applied to the two end caps or bases of the lamp, the two ends of the sleeve 26 are heated and heat sealed/adhesive sealed to the adhesive coated end caps. So that the sleeve may be slid onto the particular fluorescent lamp, the inside diameter of the sleeve is made so that there is about a 1-2 mm, more preferably about 1 mm, air gap between the outside surface of the lamp 10 and the inside surface of the sleeve 26. The difference between the outside diameter of the lamp and the inside diameter of the sleeve is preferably about 0.5-8, 1-6, 1.5-4, or 2-3, mm. The inside diameter of the sleeve is preferably at least 0.2, 0.4, 0.6, 0.8, 1, 1.2, 1.5, 1.8 or 2, mm greater than the outside diameter of the lamp.

Figure 2:
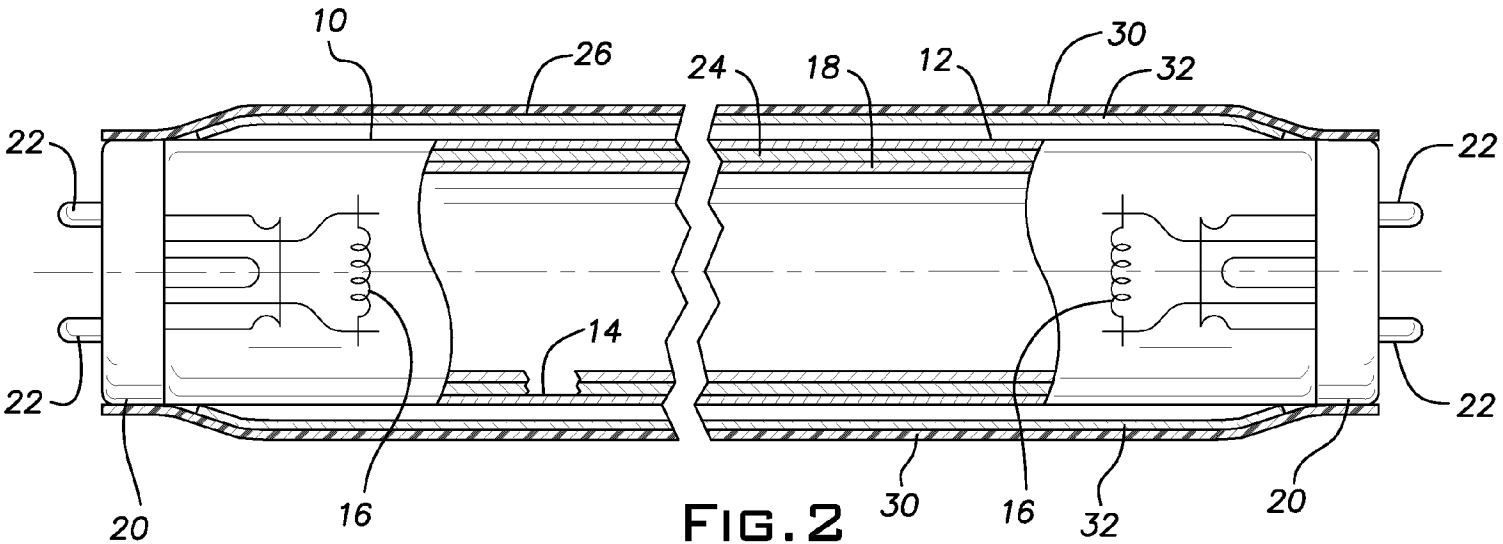
FIG. 2 shows schematically, in a second embodiment of the invention, a fluorescent lamp partially in cross section surrounded by a protective sleeve shown in cross section.

With reference to FIG. 2 there is shown a second embodiment of the invention. Like numbers in FIGS. 1 and 2 indicate like elements in FIGS. 1 and 2. The main difference between FIG. 1 and FIG. 2 is that, in FIG. 1 UV-blocking layer 28 is coated onto the outside of envelope 12, whereas in FIG. 2, UV-blocking layer 28 (now called UV-blocking layer 32) is coated on the inside surface of layer 30 of sleeve 26. UV-blocking layer 32 is the same as UV-blocking layer 28. Layer 32 can be applied to the inner surface of layer 30 preferably by dip coating, spray coating, coating with a slurry, or other coating methods known in the art. The coating weight of layer 32 is the same as the coating weight of layer 28. Preferably layer 32 does not cover the portions of sleeve 26 that seal on the bases 20, so as not to cause interference. The gap between the lamp and the sleeve is the same size in FIG. 2 as in FIG. 1.

Layers 28 and 32 function to block transmission of UV light, which if transmitted, acts to degrade, cause yellowing, cause haze, and cause brittleness, of the outer layer 30. When the sleeve 26 is degraded, it is less able to protect the lamp from impact shattering and less able to contain glass fragments from flying off. The invention protects sleeve 26 from degradation, so the lamp is more shatter resistant and, if the lamp does shatter, there is better fragment retention.

Further details and benefits of the invention are illustrated in the following Example.

Example 1

Two layers were tested for irradiance: 1. A conventional four foot linear fluorescent lamp (F32T8/SPX30) was coated on its outer surface with about 8 g of GUZ-140 from Nippan Kenkyujo ("Coated Lamp"). 2. A lamp the same as the Coated Lamp, but without the coating ("Bare Lamp"). Irradiance was measured with an Optronics Laboratories OL756 double monochromator calibrated with NIST traceable standards. The detector was placed 20 cm from the center of the lamp. The lamps were burned horizontally and run with reference photometry at line volts. The irradiance data for the Coated Lamp and Bare Lamp is given in Table 1. As can be seen, the coating was very effective in blocking UV radiation. The invented layers 28, 32 preferably permit not more than 5, 10 or 20 percent transmission at 300, 330, 350, 360, 380 and 390 nm after 50 hours of operation.

TABLE 1

| Wavelength (nm) | Irradiance of Bare Lamp W/cm$^2$ | Irradiance of Coated Lamp W/cm$^2$ |
|---|---|---|
| 288 | 2.02E−10 | 5.76E−12 |
| 290 | 1.28E−10 | 4.06E−12 |
| 292 | 3.54E−10 | 5.47E−12 |
| 294 | 3.40E−09 | 8.94E−12 |
| 296 | 5.50E−09 | 5.81E−12 |
| 298 | 3.69E−09 | 6.72E−12 |
| 300 | 1.81E−08 | 6.84E−12 |
| 302 | 2.08E−08 | 6.56E−12 |
| 304 | 2.82E−08 | 5.43E−12 |
| 306 | 4.88E−08 | 4.38E−12 |
| 308 | 8.30E−08 | 8.11E−12 |
| 310 | 3.21E−07 | 1.08E−11 |
| 312 | 5.75E−07 | 2.58E−11 |
| 314 | 1.79E−07 | 4.44E−11 |
| 316 | 1.83E−07 | 1.63E−11 |
| 318 | 1.93E−07 | 1.54E−11 |
| 320 | 2.01E−07 | 1.39E−11 |
| 322 | 2.03E−07 | 1.79E−11 |
| 324 | 2.05E−07 | 1.54E−11 |
| 326 | 2.05E−07 | 1.54E−11 |
| 328 | 2.08E−07 | 1.52E−11 |
| 330 | 2.14E−07 | 1.50E−11 |
| 332 | 2.73E−07 | 1.40E−11 |
| 334 | 2.50E−07 | 1.97E−11 |
| 336 | 2.27E−07 | 1.86E−11 |
| 338 | 2.27E−07 | 1.71E−11 |
| 340 | 2.24E−07 | 1.83E−11 |
| 342 | 2.16E−07 | 1.68E−11 |
| 344 | 2.04E−07 | 2.26E−11 |
| 346 | 1.86E−07 | 4.62E−11 |
| 348 | 1.68E−07 | 1.09E−10 |
| 350 | 1.46E−07 | 2.70E−10 |
| 352 | 1.25E−07 | 5.31E−10 |
| 354 | 1.04E−07 | 9.01E−10 |

TABLE 1-continued

| Wavelength (nm) | Irradiance of Bare Lamp W/cm$^2$ | Irradiance of Coated Lamp W/cm$^2$ |
|---|---|---|
| 356 | 8.61E−08 | 1.31E−09 |
| 358 | 7.15E−08 | 1.71E−09 |
| 360 | 6.98E−08 | 2.18E−09 |
| 362 | 4.04E−07 | 3.34E−09 |
| 364 | 1.40E−06 | 2.65E−08 |
| 366 | 2.04E−07 | 9.80E−08 |
| 368 | 3.90E−08 | 1.64E−08 |
| 370 | 2.23E−08 | 3.89E−09 |
| 372 | 1.75E−08 | 2.99E−09 |
| 374 | 2.45E−08 | 3.01E−09 |
| 376 | 4.12E−08 | 5.03E−09 |
| 378 | 5.52E−08 | 9.78E−09 |

Although the hereinabove described embodiments of the invention constitute the preferred embodiments, it should be understood that modifications can be made thereto without departing from the scope of the invention as set forth in the appended claims.

What is claimed is:

1. A sleeve-protected fluorescent lamp comprising a mercury vapor discharge fluorescent lamp surrounded by a sleeve, the fluorescent lamp comprising a light-transmissive glass envelope having an inner surface, a pair of electrode structures mounted inside said envelope, a first base sealing a first end of the lamp, a second base sealing a second end of the lamp, a discharge-sustaining fill comprising inert gas sealed inside said envelope, and a phosphor layer inside said envelope and adjacent the inner surface of the envelope, the sleeve comprising a layer of polymeric material, the sleeve-protected lamp further comprising a UV-blocking layer between the polymeric material layer and the glass envelope, the UV-blocking layer comprising a UV-blocking component of $Al_2O_3$ or ZnO or $SiO_2$ or $TiO_2$ or mixtures thereof, the inside diameter of the sleeve being at least 0.2 mm greater than the outside diameter of the lamp so that there is a gap between the lamp and the sleeve, wherein the UV-blocking layer comprises a mixture of $Al_2O_3$, ZnO and $SiO_2$.

2. The lamp of claim 1, wherein the inside diameter of the sleeve is at least 1 mm greater than the outside diameter of the lamp.

3. The lamp of claim 1, wherein the inside diameter of the sleeve is at least 1.5 mm greater than the outside diameter of the lamp.

4. The lamp of claim 1, wherein the coating weight of the UV-blocking component is 0.2-8 mg/cm$^2$.

5. The lamp of claim 1, wherein the coating weight of the UV-blocking component is 0.7-4 mg/cm$^2$.

6. The lamp of claim 1, wherein the polymeric material layer is UV-stabilized polycarbonate.

7. The lamp of claim 1, wherein the polymeric material layer is 100-1000 microns thick.

8. The lamp of claim 1, wherein the UV-blocking layer permits not more than 20% transmission at 390 nm after 50 hours of operation.

9. The lamp of claim 1, wherein the UV-blocking layer is at least 75 weight percent UV-blocking component.

10. The lamp of claim 1, wherein the coating weight of the UV-blocking component is 1-3 mg/cm$^2$.

11. The lamp of claim 1, wherein the inside diameter of the sleeve is at least 2 mm greater than the outside diameter of the lamp.

12. The lamp of claim 1, wherein the UV-blocking layer comprises binder, said binder being selected from the group consisting of polysilanes, polyacrylics, polyurethanes, copolymers of these, and mixtures thereof.

13. The lamp of claim 1, wherein the UV-blocking layer comprises binder, said binder being an inorganic binder.

14. A sleeve-protected fluorescent lamp comprising a mercury vapor discharge fluorescent lamp surrounded by a sleeve, the fluorescent lamp comprising a light-transmissive glass envelope having an inner surface, a pair of electrode structures mounted inside said envelope, a first base sealing a first end of the lamp, a second base sealing a second end of the lamp, a discharge-sustaining fill comprising inert gas sealed inside said envelope, and a phosphor layer inside said envelope and adjacent the inner surface of the envelope, the sleeve comprising a layer of polymeric material, the sleeve-protected lamp further comprising a UV-blocking layer between the polymeric material layer and the glass envelope, the UV-blocking layer comprising a UV-blocking component of $Al_2O_3$ or ZnO or $SiO_2$ or $TiO_2$ or mixtures thereof, the inside diameter of the sleeve being at least 0.2 mm greater than the outside diameter of the lamp so that there is a gap between the lamp and the sleeve, wherein the UV-blocking layer is a coating on the outside surface of the glass envelope, wherein the UV-blocking layer comprises a mixture of $Al_2O_3$, ZnO and $SiO_2$.

15. The lamp of claim 14, wherein the inside diameter of the sleeve is at least 1 mm greater than the outside diameter of the lamp.

16. The lamp of claim 14, wherein the coating weight of the UV-blocking component is 0.2-8 mg/cm$^2$.

17. The lamp of claim 14, wherein the coating weight of the UV-blocking component is 0.7-4 mg/cm$^2$.

18. The lamp of claim 14, wherein the UV-blocking layer permits not more than 20% transmission at 390 nm after 50 hours of operation.

* * * * *

UNITED STATES PATENT AND TRADEMARK OFFICE

CERTIFICATE OF CORRECTION

PATENT NO. : 8,053,962 B2
APPLICATION NO. : 12/435215
DATED : November 8, 2011
INVENTOR(S) : James Michael Kostka et al.

It is certified that error appears in the above-identified patent and that said Letters Patent is hereby corrected as shown below:

Column 2, line 64, please delete "3040" and insert therefor -- 30-40 --.

Signed and Sealed this
Twenty-seventh Day of March, 2012

David J. Kappos

David J. Kappos
*Director of the United States Patent and Trademark Office*